US005521461A

United States Patent [19]

Garcia

[11] Patent Number: 5,521,461

[45] Date of Patent: May 28, 1996

[54] METHOD FOR PRODUCING MICRODOT-EMITTING CATHODES ON SILICON FOR COMPACT FLAT SCREENS AND RESULTING PRODUCTS

[75] Inventor: Michel Garcia, Les Milles, France

[73] Assignee: Pixel International, France

[21] Appl. No.: 256,977

[22] PCT Filed: Dec. 3, 1993

[86] PCT No.: PCT/FR93/01191

§ 371 Date: Feb. 1, 1995

§ 102(e) Date: Feb. 1, 1995

[87] PCT Pub. No.: WO94/14182

PCT Pub. Date: Jun. 23, 1994

[30] Foreign Application Priority Data

Dec. 4, 1992 [FR] France ..... 92 14894

[51] Int. Cl.[6] ..... H01J 9/02

[52] U.S. Cl. ..... 313/336; 445/24

[58] Field of Search ..... 445/24, 50; 313/309, 313/336, 351

[56] References Cited

U.S. PATENT DOCUMENTS

| | | | |
|---|---|---|---|
| 4,163,949 | 8/1979 | Shelton | 313/309 |
| 4,983,878 | 1/1991 | Lee et al. | 445/24 X |
| 5,176,557 | 1/1993 | Okunuki et al. | 445/24 |
| 5,228,878 | 7/1993 | Komatsu | 445/24 |
| 5,329,207 | 7/1994 | Cathey et al. | 445/24 X |

OTHER PUBLICATIONS

Patent Abstracts of Japan, vol. 17, No. 22 (E 1307) (JP A 4249827) 14 Jan. 1993.

Patent Abstracts of Japan, vol. 6, No. 47 (JP A 56 160740 Dec. 1981) 10 Dec. 1981.

Patent Abstracts of Japan, vol. 16, No. 37 (JP A 3 246852 Nov. 1991) 5 Nov. 1991.

*Primary Examiner*—Kenneth J. Ramsey

*Attorney, Agent, or Firm*—Plevy & Associates

[57] ABSTRACT

A method for producing microdot emitting cathodes on silicon for compact flat screens, and the products obtained by means of said method, are disclosed. According to the method, the emitting cathodes are made from a basic monolithic silicon substrate (1) consisting of a thick wafer (at least 300 microns) or a thin film a few microns thick on an insulating substrate (alumina or glass), the silicon film being "active" in both cases. The method is useful in the field of flat display screens based on the physical phenomenon of cathodoluminescence and field effect electron emission, and in all industrial sectors using compact display screens, e.g. video camera viewfinders, calculators, monitoring devices of all kinds, vehicles, watches and clocks, etc.

10 Claims, 1 Drawing Sheet

METHOD FOR PRODUCING MICRODOT-EMITTING CATHODES ON SILICON FOR COMPACT FLAT SCREENS AND RESULTING PRODUCTS

FIELD OF THE INVENTION

The present invention relates generally to microtip-emitting cathodes on silicon for compact flat screens.

More specifically, the present invention relates to flat display screens based on the physical phenomenon of cathodoluminescence and field effect electron emission. Further, the present invention can be applied in all industrial sectors using compact display screens, for example, video camera view finders, calculators, monitoring devices of all kinds, vehicles, watches, and clocks, etc.

BACKGROUND OF THE INVENTION

The microtip screens are characterized by an electronic field effect emission from an extended plane microtip cathode, a low consumption cold cathode, a rapid response time (1 μs), a matrix addressing from the integrated tip-grid structure and a luminous emission by cathodoluminescence at a low/average voltage.

Known microtip screens are vacuum tubes generally constituted of two thin glass plates (approximately 1 mm), distanced by 200 μm. The rigidity of the structure is ensured by spacers (balls of 200 μm, for example) which enable the interelectrode distance to be maintained when the screen is placed under vacuum.

The front plate or anode plate is covered by a transparent conducting layer and luminophores.

The rear plate or cathode plate comprises a matrix network of field effect emitters deposited by thin film technology.

Each luminous dot (pixel) is associated with an oppositely located cathodic emitting surface and constituted of a large number of microtips (approximately 10,000 per $mm^2$).

This emitting surface is defined by the intersection of a line (grid) and a column (cathodic conductor) of the matrix.

Subject to the introduction of a device for limiting the current in the tips, the large number of tips ensures a homogeneous emission between pixels (average effect) and eliminates the risks of local defects.

By virtue of the short tip-grid distance ($\leqq 1$ μm) and the amplifying effect of the tip, a potential difference of less than 100 volts applied between line and column enables obtention, at the top of the tip, of an electric field greater than 10 to the power of 7 volts/cm, sufficient to cause the emission of electrons.

To fix the order of magnitude, a potential difference of 80 volts allows a current density of 1 $mA/mm^2$ to be obtained. This value is sufficient in a screen of 1,000 lines, controlled sequentially line by line to obtain a high luminance (400 $cd/m^2$) with a low voltage luminophore (400 volts) having a luminous yield of 3 lm/watt.

In light of the emission threshold (40–50 volts), the voltage which must be modulated on the columns to pass from the black level to the white level, is of the order of 30 to 40 volts.

The conventional structure of the cathode of a microtip screen especially comprises, deposited successively on a substrate of glass or silicon:

an insulation layer, a resistive layer of silicon or other material,

"column conductors" constituted of a metallic layer which can be deposited either beneath or above the resistive layer, an insulating layer (Si or SiO2) which constitutes the grid insulator, a metallic layer which constitutes the grid.

After depositing the aforementioned layers, holes on which the microtips are then produced, are drilled into the grid and the grid insulators by known etching techniques.

SUMMARY OF THE INVENTION

The method according to the present invention leads to an improvement of the characteristics, as well as better manufacturing yields in the production of microtip-emitting cathodes for compact flat screens of the cathodoluminescence type, and allows the use of known techniques for forming components in silicon.

It consists of producing emitting cathodes from a basic monolithic silicon substrate consisting either of a thick wafer (300 microns or more) or a thin film a few microns thick, deposited on an insulating substrate (alumina or glass), the silicon film being "active" in both cases.

BRIEF DESCRIPTION OF THE DRAWINGS

In the annexed schematic drawings, provided as a non-limiting example of one of the embodiments of the object of the invention.

DETAILED DESCRIPTION OF THE DRAWINGS

The method according to the present invention is intended to produce microtip-emitting cathodes for compact flat screens using a basic silicon substrate 1 consisting either of a thick wafer (300 microns or more), or a thin film a few microns thick, deposited on an insulating substrate (alumina or glass). In both cases, the silicon layer can be used advantageously to implant active components, such as depletion transistors ensuring control and limitation of the current in the microtips.

The emitting cathodes can be manufactured by known techniques for producing integrated components on silicon. In addition, the collectivization of treatments allows several cathodes to be manufactured at the same time on the same wafer, and several wafers to be treated at the same time during technological stages.

The thick wafer is constituted of a massive silicon plate having a diameter of 100 to 200 mm (but non-limiting), of the type commonly used for manufacturing integrated circuits. It is of the P- or N-type with an adapted, preferably high, resistivity. It can also be made of an insulating substrate (glass, alumina, etc. . . . ) covered by a layer of silicon approximately 1 micron thick, or else by any kind of known substrate allowing silicon structures to be produced on an insulator.

As for the thin film of silicon, the basic substrate can be a plate of silicon, alumina, glass, or other. The thin film itself is crystalline (epitaxial layer) or polycrystalline, having a high resistivity (from a few ohms-cm to 50 ohms-cm).

At each manufacturing stage, the cleaning phases are identical to those which precede the stages of the integrated circuit production method. They consist of immersion in acid baths (phosphoric, hydrochloric, hydrofluoric, sulfuric) rinsing with deionized water, drying be centrifuge or alcohol vapor, etc. . . . .

Figure 1:
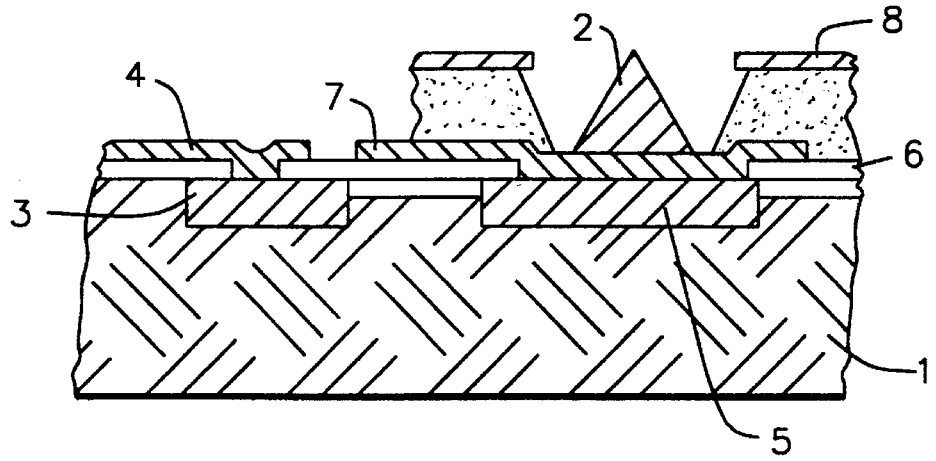
FIG. 1 represents the transverse section of a microtip-emitting cathode according to the invention.

FIG. 1 shows a partial section of an emitting cathode with microtips protected by depletion transistors, the latter being produced from the silicon substrate 1 in which are formed over-doped zones, obtained by diffusion and constituting sources 3 in contact with column conductors 4, and drains 5 supplying microtips 2, as well as a grid insulation layer 6 made of silica, obtained by surface oxidizing. A gate electrode 7 is created by metallization above a gate insulation layer 6.

Column conductors 4 are constituted either by a metallic layer (aluminum, for example), or by one or more zones diffused in the silicon substrate, or by combining the two techniques: diffused layer+metallic layer.

The use of a diffused layer allows the height of the structure to be limited.

Figure 2:
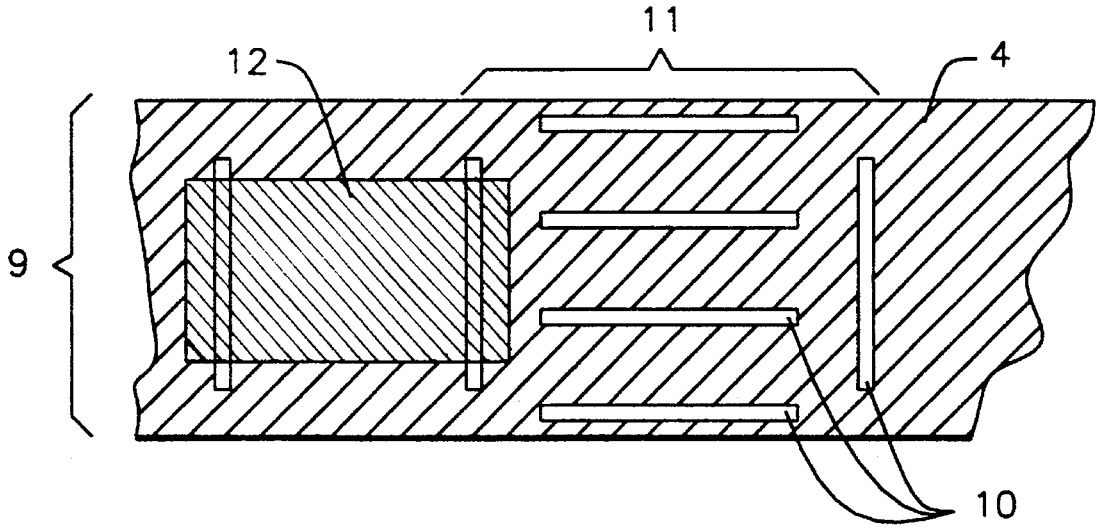
FIG. 2 is a top view of such a cathode showing a special embodiment of the column conductors.

The diffused layer can extend on the entire surface of column 9, to reduce its resistance. In that case, it is insulated from the upper structures by a thick oxide layer (1 to 2 microns) in which contact holes 10 with the upper layers are formed. The diffused layer can also be limited at the surface of a pixel 11, column 9 then being constituted of over-doped zones in series with metallic zones 12, which interconnect the over-doped zones (FIG. 2).

If column conductor 4 is a metallic layer, one can use a structure which separates the first emitting tip from the column metallization by a required distance (3 microns for example).

If the conductor column is a layer diffused in the silicon substrate, the same principle can be used to produce the same effect.

Both of the aforementioned principles (use of a diffused layer for the column conductor and its alignment) enable the release of a maximum emitting space. In deed, in both cases, the encroachment of column conductor 4 on the surface of the pixel is reduced to making contact. The conductor being either beneath the emitting zone (diffused layer) or in the inter-pixel space (metal).

Grid 8 (metallic) forming the line conductors, can be covered advantageously by an insulating layer (silicon nitride, diamond carbon, SiO2 or other). The insulation between grid 8 and anode is thereby improved. This layer will usually be deposited before forming the holes and the microtips.

The positioning of various constituent elements provides the object of the invention with a maximum of useful effects which, to date, have not been obtained by similar methods.

I claim:

1. A microtip emitting cathode for a flat display screen, comprising:

at least one MOS transistor having a drain region coupled to a gate region;

a cathode conductor; and an emitting microtip coupling said at least one MOS transistor with said cathode conductor.

2. The microtip emitting cathode according to claim 1, wherein said at least one MOS transistor is formed on a silicon substrate, and said emitting microtip is disposed over said drain of said at least one MOS transistor.

3. The microtip emitting cathode according to claim 2, further comprising a layer of metallization which couples said drain with said gate of said at least one MOS transistor, said microtip being disposed on said layer of metallization.

4. The microtip emitting cathode according to claim 1, wherein said cathode conductor is column-shaped and comprises a plurality of sources which are coupled together.

5. The microtip emitting cathode according to claim 1, wherein said at least one MOS transistor comprises a plurality of MOS transistors.

6. A method for producing a microtip emitting cathode for flat display screen, comprising the steps of:

providing substrate having at least one MOS transistor having a drain region coupled to a gate region;

depositing a cathode conductor on said substrate; and coupling said at least one MOS transistor to said cathode conductor with an emitting microtip.

7. The method according to claim 6, wherein said emitting microtip is disposed over said drain of said at least one MOS transistor.

8. The method according to claim 7, further comprising the step of depositing a layer of metallization which couples said drain with said gate of said at least one MOS transistor wherein said microtip is disposed on said layer of metallization.

9. The method according to claim 6, wherein said cathode conductor is column-shaped and comprises a plurality of sources which are coupled together.

10. The method according to claim 6, wherein said at least one MOS transistor comprises a plurality of MOS transistors.

* * * * *